United States Patent [19]

Spinnler

[11] Patent Number: 4,950,138

[45] Date of Patent: Aug. 21, 1990

[54] SPIRAL DISPLACEMENT MACHINE WITH FLEXIBLE ECCENTRIC GUIDE ARRANGEMENT

[75] Inventor: Fritz Spinnler, Mellingen, Switzerland

[73] Assignee: BBC Brown Boveri AG, Baden, Switzerland

[21] Appl. No.: 282,737

[22] Filed: Dec. 12, 1988

[30] Foreign Application Priority Data

Dec. 21, 1987 [CH] Switzerland ..... 4982/87

[51] Int. Cl.[5] ..... F04C 18/04

[52] U.S. Cl. ..... 418/55.3; 418/60

[58] Field of Search ..... 418/55 A, 55 B, 57, 418/60

[56] References Cited

U.S. PATENT DOCUMENTS 3,989,422 11/1976 Guttinger ..... 418/60

FOREIGN PATENT DOCUMENTS 2603462 3/1982 Fed. Rep. of Germany .
3107231 9/1982 Fed. Rep. of Germany .
3230979 2/1984 Fed. Rep. of Germany .
585340 12/1924 France .
2532370 3/1984 France .
150363 9/1920 United Kingdom .

*Primary Examiner*—John J. Vrablik
*Attorney, Agent, or Firm*—Burns, Doane, Swecker & Mathis

[57] ABSTRACT

In a displacement machine for compressible media, having four delivery spaces arranged in a fixed housing, each housing half (7) has two delivery spaces (11, 11') which are offset by about 180° with respect to one another and extend in a spiral shape from an inlet (12,12') to an outlet (13). Each delivery space is allocated a displacement body which fits into the latter and is held, as a spiral-shaped strip (3,3') perpendicularly on a disk-shaped rotor (1) which can be driven eccentrically with respect to the housing. For the guidance of said rotor a second eccentric guiding arrangement (10) arranged at an interval from a first eccentric drive arrangement (9) is provided in the housing. For the flexible accommodation of any length differences between delivery space and displacement body, the guide eye (5) of the eccentric guiding arrangement is connected to the disk-shaped rotor (1) via a stem (29) which is formed as a tangential extension on the inlet-side end of one of the spiral-shaped strips (3).

3 Claims, 3 Drawing Sheets

SPIRAL DISPLACEMENT MACHINE WITH FLEXIBLE ECCENTRIC GUIDE ARRANGEMENT

BACKGROUND OF THE INVENTION

1. Field of the Invention

The invention relates to a displacement machine for compressible media having at least four delivery spaces arranged in a fixed housing, in the case of four delivery spaces each housing half having two delivery spaces which are offset by about 180° with respect to one another and extend in a spiral shape from an inlet to an outlet, and each delivery space being allocated a displacement body which fits into the latter and is held, as a spiral-shaped strip, perpendicularly on a disk-shaped rotor which can be driven eccentrically with respect to the housing and for the guidance of which a second eccentric guiding arrangement arranged at an interval from a first eccentric drive arrangement is provided in the housing, there being provided on the rotor a compensating means for the flexible accommodation of any length differences between delivery space and displacement body.

2. Discussion of Background

Displacement machines on the spiral principle are known, for example, from DE-C3-2,603,462 which corresponds to U.S. Pat. No. 3,989,422. These machines are distinguished by a virtally pulsation-free delivery of the gaseous working medium comprising air or an air/fuel mixture and can therefore also be employed with advantage for the purpose of supercharging internal combustion engines. During the operation of a displacement machine of this kind, working as a compressor, a plurality of approximately crescent-shaped working spaces which move through the delivery chamber from a working medium inlet to a working medium outlet are enclosed along the delivery chamber between the spiral-shaped displacement body and the two cylinder walls of the delivery chamber as a result of the different curvature of the spiral shapes, the volume of said working spaces decreasing constantly and the pressure of the working medium being correspondingly increased. The displacement bodies are formed by spiral-shaped strips which are held essentially perpendicular on the disk-shaped rotor and have a relatively great axial length in relation to their thickness. Similar conditions apply on the side of the fixed housing, where spiral-shaped, strip-like webs remain between the delivery chambers, said webs having a relatively great length in the axial and in the peripheral direction in relation to their wall thickness.

A precise rolling contact of a displacement body on the spiral principle by virtue of a translational circular motion is achieved by means of a double crank mechanism, such as that known, for example, from DE-A-3,230,979 and in which one crank drives and the second crank guides. In order to be able to compensate length differences between the two points of application of the drive and the guide arrangements, this known solution envisages a transmission member which can be displaced longitudinally, i.e. in the direction of the line connecting the points of application. This transmission member comprises a holding member which is held displaceably in the guide arrangement of the rotor and can be a slider which is displaceable in a parallel guide. The parallel guide comprises one of the two bearings of the guide arrangement, via which any compensation of differences in expansion can thus take place.

Another solution to this problem is described in DE-A-3,107,231. To avoid impermissibly high loads, which may occur by reason of tolerance summation in production or by reason of differential thermal expansion between the two points of application at the rotating rotor, a bearing arrangement provided with an elastic bedding is provided at at least one of the points of application, preferably at the point of application of the guide device. This elastic bedding can, for example, be formed by a rubber-elastic ring which rests between bearing outer ring and bearing eye.

SUMMARY OF THE INVENTION

Accordingly, one object of this invention is, in the case of a displacement machine of the type stated at the outset, to create a novel further possibility of accommodating length changes occurring between two points of application, which is of as simple a design as possible and brings about automatic compensation.

According to the invention, this is achieved by the fact that the guide eye of the eccentric guiding arrangement is connected to the disk-shaped rotor via a stem which is formed as a tangential extension on the inlet-side end of one of the spiral-shaped strips.

By means of this measure, a high rigidity in the tangential direction and a high elasticity in the radial direction are achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

For an explanation of the mode of operation of the compressor, which is not the subject-matter of the invention, reference is made to the abovementioned DE-C3-2,603,462 which corresponds to U.S. Pat. Nos. 3,989,422. In the text which follows, a brief description is given only of that part of the machine design and the course of the process which is necessary for the sake of understanding.

Figure 2:
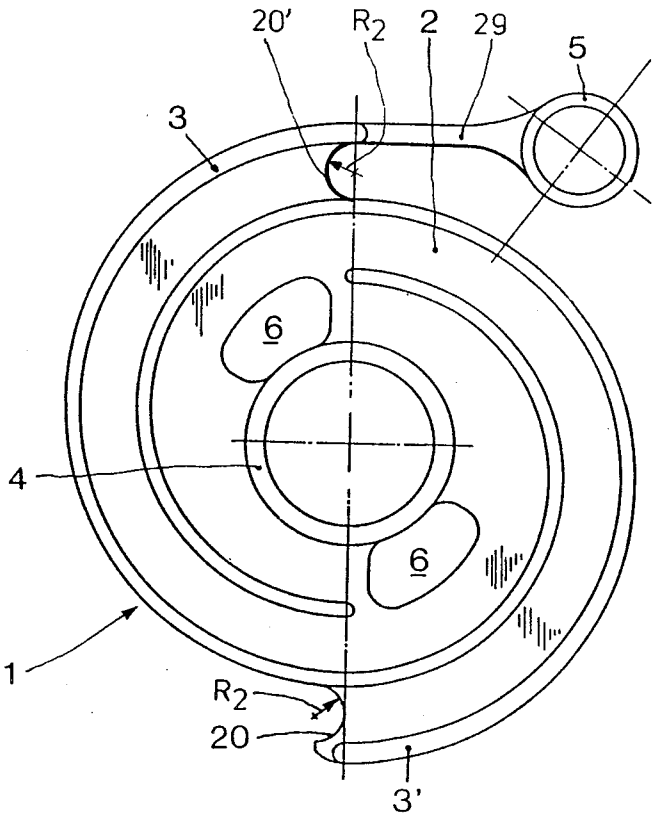
FIG. 2 shows a rotor with a guide eccentric in accordance with the invention.
Figure 1:
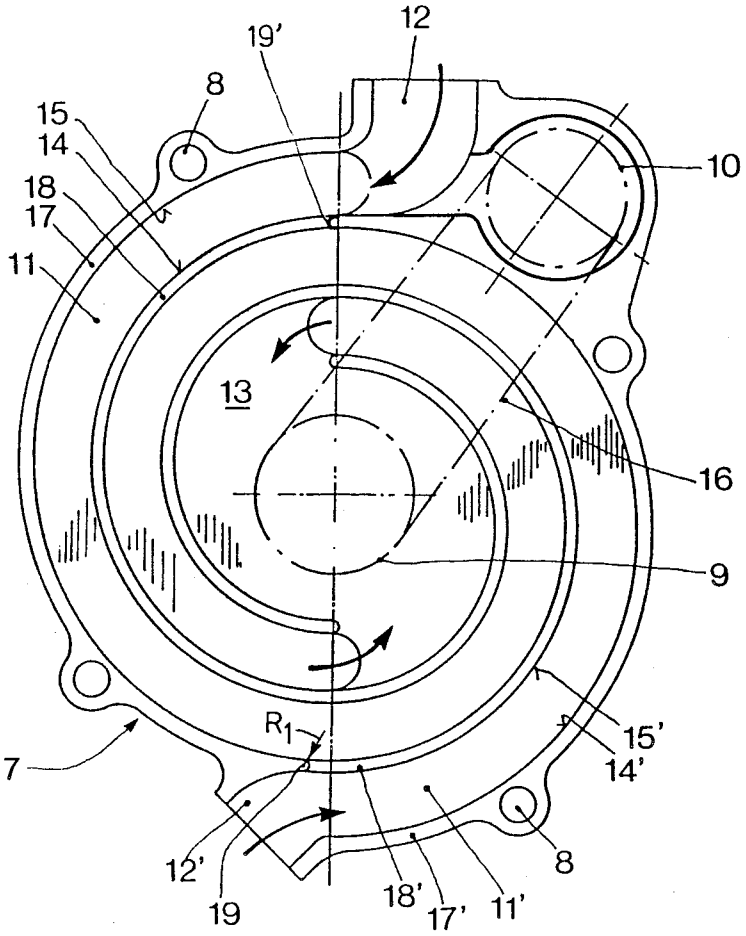
FIG. 1 shows a housing part of the displacement machine.

Referring now to the drawings, wherein like reference numerals designate identical or corresponding parts throughout the several views, in FIGS. 1 and 2 the machine is shown disassembled for the sake of clarity.

1 designates overall the rotor of the machine. Two spirally extending displacement bodies offset by 180° with respect to one another are arranged on both sides of the disk 2. Said displacement bodies are strips 3, 3' which are held perpendicularly on the disk 2. In the example shown, the spirals themselves are formed by a plurality of mutually adjoining circular arcs. As a result of the wide ratio, mentioned at the outset, between axial length and wall thickness (FIG. 3), the inlet-side end of the strips 3,3' is in each case of reinforced design. 4 designates the hub by which the disk 2 is mounted on the rolling bearing 22. The bearing itself rests on an eccentric disk 23 which, for its part, is part of the drive shaft 24. 5 designates an eye for accommodating a guide bearing 25 which is mounted on an eccentric pin 26, said eye being arranged radially to the outside of the strips 3,3'. Said eccentric pin, for its part, is part of a guide shaft 27. The eccentricity e of the eccentric disk on the drive shaft corresponds to that of the eccentric pin on the guide shaft. At the outlet of the spirals, openings 6 are provided in the disk 2 to enable the medium to pass from one side of the disk to the other, for example to be discharged in a central outlet arranged on only one side.

Figure 3:
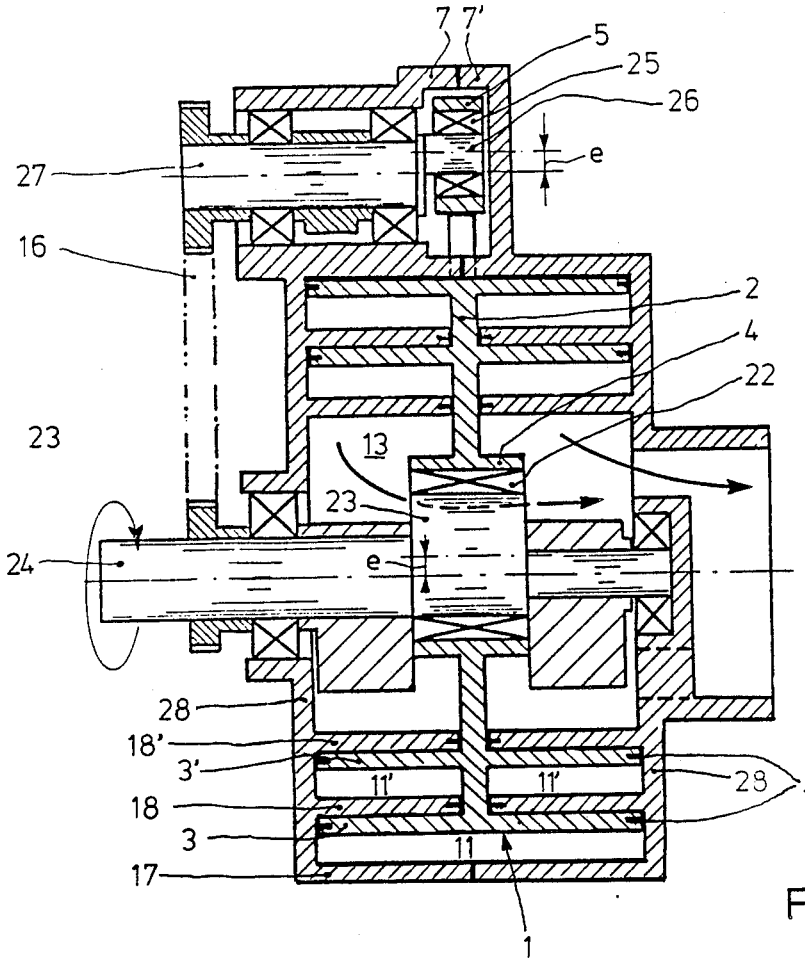
FIG. 3 shows a longitudinal section through the displacement machine.

In FIG. 1, the housing half 7, represented on the left in FIG. 3, of the machine housing, which is composed of two halves (7,7') and is connected together via fixing lugs 8 for accommodating screw fasteners, is shown. 9 symbolizes the receiver for the drive shaft, 10 the receiver for the guide shaft. 11 and 11' designate the two delivery spaces, which are in each case offset by 180° with respect to one another and are machined into the two housing halves in the manner of a spiral-shaped slot. They extend from in each case one inlet 12,12' arranged in the housing at the outer periphery of the spiral to an outlet 13 provided in the interior of the housing and common to both delivery spaces. They have essentially parallel cylinder walls 14,14',15,15' which are arranged at a constant interval from one another and, in the present case, like the displacement bodies of the disk 2, encompass a spiral of about 360°. The displacement bodies 3,3' fit in between these cylinder walls, the curvature of said displacement bodies being dimensioned so that the strips almost touch the inner and the outer cylinder walls of the housing at several locations, for example at in each case two locations.

At the free end faces of the strips 3,3' and of the webs 17,18, spring-loaded seals 21 are inserted in corresponding grooves. By means of these, the working spaces are sealed with respect to the side walls 28 of the housing and the displacement disk respectively.

From FIG. 1, it can be seen that in the region of the inlet 12' the web 17 having the outer cylinder wall 14 is continued by the web 18' having the inner cylinder wall 15'. This measure also applies in the region of inlet 12. Here, the transition is from web 17' to web 18.

The drive and the guidance of the rotor 1 are provided by the two spaced eccentric arrangements (23,24 and 26,27). In order to achieve well-defined guidance of the rotor in the dead center positions, the two eccentric arrangements are kept in exact angular synchrony via a timing belt drive 16. This double eccentric drive ensures that all points of the rotor disk and hence also all points of the two strips 3 and 3' execute a circular displacement motion.

As a result of the multiple alternating approaches of the strips 3,3' to the inner and outer cylinder walls of the associated delivery chamber is, crescent-shaped working spaced are formed on both sides of the strips, said working space is enclosing the working medium and being displaced through the delivery chambers in the direction of the outlet during the actuation of the rotor disk. In the process, the volumes of these working spaces are reduced and the pressure of the working medium is correspondingly increased.

FIG. 1 shows that—apart from the radially protruding eye 5—the disk 2 ends radially at the strips 3, 3'. This means that, in the radial direction, the disk must pass through at least one housing half in the region of the inlets 12,12'. In the present case, this occurs at the housing half 7 illustrated on the left in FIG. 3. For this purpose, its inner webs 18,18' are lowered with respect to the outer webs 17, 17' by the amount of the disk thickness. This measure has the advantage that, in this housing half, sealing strips have to be arranged only on the inner webs 18,18', sealing the delivery spaces 11,11' with respect to one another via the disk 2 as far as the outlet.

If the transition from web 17 to web 18' were to be sharp-edged and radial and if, consequently, the disk 2 were also to end radially at the corresponding inlet parts, a leakage would occur between the delivery chambers 11 and 11'.

As can be seen from FIG. 1, this transition is henceforth designed as a circular shoulder 19,19' having the radius R1. The corresponding surface on the disk 2 is provided with a recess 20,20' of corresponding circular arc shape, the radius R2 of this recess corresponding to the eccentricity e+radius R1. During the operation of the machine, these shoulders 19,19' cooperate for the purpose of forming a sealing line with the circular arc-shaped recesses 20,20'.

In contrast to the design according to DE-A-3,107,231 discussed at the outset—in which the point of application of the guide device, i.e. the guide eye for accommodating the eccentric, is rigidly integrated in the displacement disk—the guide eye 5 is in the present case connected to the rotor 1 via a stem 29.

Figure 4:
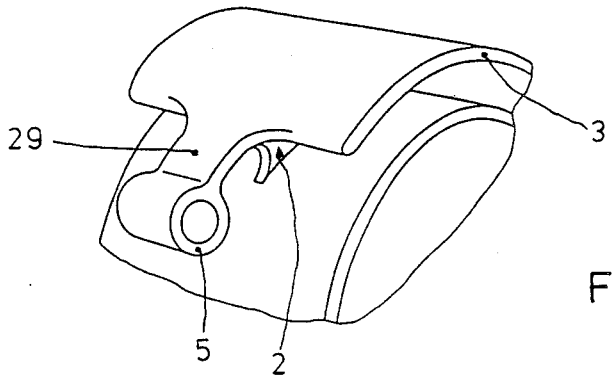
FIG. 4 shows a perspective representation of part of the guide eccentric.

In its longitudinal extension, the stem 29 runs tangentially to the spiral. It is connected to the inlet-side end of the spiral strip 3. In FIG. 4, it is represented as a stem produced integrally with the rotor. Its width preferably corresponds to the width of the guide eye 5; its thickness is chosen such that the guide eye is elastic in the radial direction.

Figure 5:
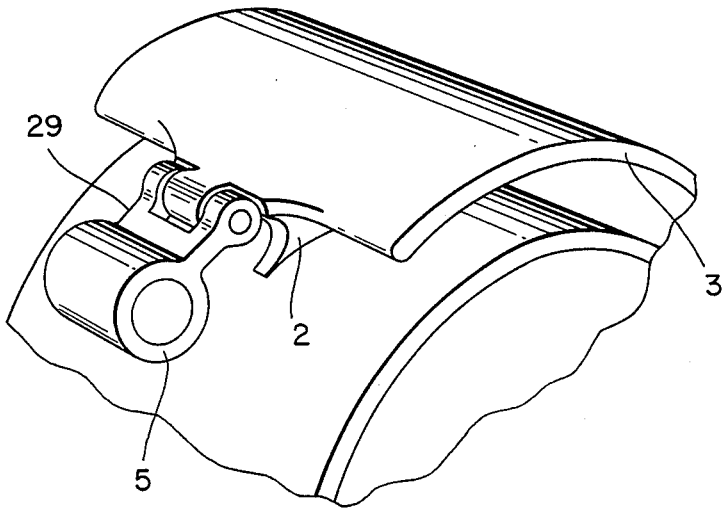
FIG. 5 shows a perspective representation of part of the guide eccentric in an articulated arrangement.

Departing from the embodiment shown, in which the stem 29 is of the same material as the rotor, the stem can also be produced separately with or without a guide eye, for example of a material which is particularly suitable for the loads which occur. In this case, the stem can be connected to the rotor in any manner suitable, it being possible, in particular, to provide an articulated arrangement as shown in FIG. 5.

Obviously, numerous modifications and variations of the present invention are possible in light of the above teachings. It is therefore to be understood that within the scope of the appended claims, the invention may be practiced otherwise than as specifially described herein.

What is claimed as new and desired to be secured by Letters Patent of the United States is:

1. A displacement machine for compressible media including a fixed housing formed of two housing halves, each housing half having two of at least four delivery spaces offset by about 180° with respect to one another, said at least two delivery spaces each extending in a spiral shape from a corresponding inlet to an outlet, and each delivery space having a corresponding displacement body engaged with said delivery space, each displacement body formed as a spiral-shaped strip and perpendicularly fixed on a disk-shaped rotor, said rotor drivable eccentrically with respect to the housing and being guided by a second eccentric guiding arrangement disposed at an interval from a first eccentric drive arrangement, said first eccentric drive arrangement and said second eccentric guiding arrangement being disposed in the housing, said rotor having a means for flexibly compensating any length differences between said delivery space and said displacement body, said means for flexibly compensating including a guide eye of the second eccentric guiding arrangement wherein said guide eye is connected to the disk-shaped rotor by a stem, said stem being formed as a tangential extension at an inlet-side end of one of the spiral-shaped strips wherein said stem is rigid in a tangential direction and elastic in a radial direction.

2. A displacement machine as claimed in claim 1, wherein the stem is composed of the same material as the strip and is integral with the rotor.

3. A displacement machine as claimed in claim 1, wherein the stem is connected in articulated fashion to the rotor.

* * * * *